US010859979B2

(12) United States Patent
Bonadei et al.

(10) Patent No.: US 10,859,979 B2
(45) Date of Patent: Dec. 8, 2020

(54) SKELETON WATCH INCLUDING A MOVEMENT INDEPENDENT OF THE CASE MIDDLE

(71) Applicant: The Swatch Group Research and Development Ltd, Marin (CH)

(72) Inventors: Silvano Bonadei, Delemont (CH); Damien Goyet, Winkel (FR); Vittorio Zanesco, Neuchatel (CH); Laurent Mouche, Nidau (CH)

(73) Assignee: The Swatch Group Research and Development Ltd, Marin (CH)

( * ) Notice: Subject to any disclaimer, the term of this patent is extended or adjusted under 35 U.S.C. 154(b) by 211 days.

(21) Appl. No.: 16/012,799

(22) Filed: Jun. 20, 2018

(65) Prior Publication Data

US 2019/0025765 A1 Jan. 24, 2019

(30) Foreign Application Priority Data

Jul. 24, 2017 (EP) ..... 17182850

(51) Int. Cl.
*G04B 45/02* (2006.01)
*G04B 19/04* (2006.01)
(Continued)

(52) U.S. Cl.
CPC ..... *G04B 45/02* (2013.01); *G04B 19/04* (2013.01); *G04C 3/008* (2013.01); *G04C 3/12* (2013.01); *G04C 3/14* (2013.01); *G04G 17/04* (2013.01)

(58) Field of Classification Search
CPC ..... G04B 3/12; G04B 45/02; G04B 19/04; G04G 17/04; G04C 3/008; G04C 3/14
See application file for complete search history.

(56) References Cited

U.S. PATENT DOCUMENTS 4,362,397 A * 12/1982 Klingenberg ..... G04B 19/046 368/233
4,475,822 A 10/1984 Muller et al.
(Continued)

FOREIGN PATENT DOCUMENTS

| | | |
|---|---|---|
| CH | 636 774 | 6/1983 |
| EP | 0 360 140 A1 | 3/1990 |
| EP | 3 182 226 A1 | 6/2017 |

OTHER PUBLICATIONS

European Search Report dated Feb. 9, 2018 in European application No. 17182850.2, filed on Jul. 24, 2017 ( with English Translation of Categories of Cited Documents).

*Primary Examiner* — Sean Kayes
(74) *Attorney, Agent, or Firm* — Oblon, McClelland, Maier & Neustadt, L.L.P.

(57) ABSTRACT

A skeleton watch includes a case middle which defines an interior space, a crystal and a back cover fixed to the case middle on either side of the middle to enclose the interior space, and a movement. The movement includes an open-worked frame having a front face and a back face, the frame including an outer perimeter formed by two side positions, a top bar that connects between upper ends of the side posts, and a lower platform connected to lower ends of the side posts. The frame includes a central island positioned within the outer perimeter. The movement also includes a minute hand and an hour hand mounted on a central arbor integral with the frame. The movement also includes a motor having an electromagnet that extends outside of the outer perimeter of the frame in a radial direction from the central arbor.

11 Claims, 7 Drawing Sheets

(51) Int. Cl.

| | |
|---|---|
| ***G04C 3/12*** | (2006.01) |
| ***G04G 17/04*** | (2006.01) |
| ***G04C 3/00*** | (2006.01) |
| ***G04C 3/14*** | (2006.01) |

(56) References Cited

U.S. PATENT DOCUMENTS

| | | | | |
|---|---|---|---|---|
| 4,534,660 | A * | 8/1985 | Laesser | G04B 29/02 368/220 |
| 4,926,401 | A | 5/1990 | Vuilleumier et al. | |
| 6,275,450 | B1 * | 8/2001 | Makiba | G04B 19/06 368/223 |
| 6,666,576 | B2 * | 12/2003 | Kaelin | G04B 37/0008 368/295 |
| D731,901 | S * | 6/2015 | Mille | D10/39 |
| D743,814 | S * | 11/2015 | Miodrag | D10/39 |
| D799,342 | S * | 10/2017 | Mille | D10/30 |
| 2002/0131332 | A1 * | 9/2002 | Kaelin | G04B 37/0008 368/281 |
| 2009/0003141 | A1 * | 1/2009 | Ozawa | G04G 17/08 368/294 |
| 2017/0031321 | A1 * | 2/2017 | Buttet | G04B 19/06 |
| 2017/0168460 | A1 | 6/2017 | Willemin et al. | |

* cited by examiner

VII
14
12
16
13
19
35
47
52
48
25
36
105
104
104
20
26
23
24
22
96
21
97
90
78
VII
34
26
27
15
16
24
78
103
102
117
103
102
101
103
100
102
103
102
84
86
87
85
84
58
86
113
114
116
115
108
59
56
83
93
95
94
60
55
92
88
89
57
106
107
81
110
111
109
112
83
82
119
67
69
119
74
66
65
61
73
69
119
74
99
98
91
62
77
76
63
68
71
64
79
72
66
75
77
118
118
118
118
118
118
118

SKELETON WATCH INCLUDING A MOVEMENT INDEPENDENT OF THE CASE MIDDLE

This application claims priority from European Patent Application No. 17182850.2 filed on Jul. 24, 2017, the entire disclosure of which is hereby incorporated herein by reference.

FIELD OF THE INVENTION

The invention concerns the field of horology. It concerns, more specifically, a quartz skeleton watch, i.e. an analogue display watch (with hands) with an electric motor, which at least partly displays its internal parts.

BACKGROUND OF THE INVENTION

There is known from European Patent Application No 360140 a skeleton watch that includes a case middle bearing a top crystal and a back cover, and a frame carrying the watch hands and arranged in a space circumscribed by the case middle between the top crystal and the back cover.

This watch is powered by an electrical circuit with a quartz. The circuit includes pads and conductors directly formed on the case back.

This watch is satisfactory but could be improved.

Firstly, any intervention requiring removal of the back cover is likely to damage the pads and conductors, particularly when the horologist inserts screwdriver blades to separate the back cover from the case middle (which may scratch the pads or conductors), or when he levers off the back cover for the same purpose (which bends the back cover and may split the pads or conductors).

Secondly, the fact that the conductors and pads are formed directly on the back cover (intended to be in direct contact with the skin) means that they are subjected to thermal cycles (according to whether or not the watch is worn) which are also likely to damage them.

Thirdly, removing the back cover, which may be necessary to identify a defect observed, for example, in the mechanism, shuts off the electrical circuit, and consequently stops the mechanism, hindering identification of the defect.

SUMMARY OF THE INVENTION

The invention aims to propose a skeleton watch that fulfils at least one of the following objectives:

- protecting the electronic circuit from shocks and stresses during any intervention in the watch requiring access to the movement;
- thermally insulating, as far as possible, the electronic circuit from the back cover;
- allowing the watch to operate even when the back cover is removed during an intervention.

To this end, there is proposed a skeleton watch including:

- a case middle which defines an interior space;
- a crystal and a back cover fixed to the case middle on either side of the latter to enclose the interior space;
- a movement that includes:
  - an openworked frame having a front face and a back face;
  - time display means mounted, on the front face side of the frame, on a central arbor integral with the frame, the time display means including, in particular, a minute hand and an hour hand;

- a reduction mechanism meshed with the time display means;
  - a motor including:
    - an electromagnet;
    - a stator;
    - a rotor bearing a pinion meshed with the reduction mechanism;
- an electronic circuit including:
  - a piezoelectric quartz;
  - a control circuit connected to the quartz and to the stator by means of electrical conductors;
- an additional plate which carries the electronic circuit, this additional plate being distinct from the back cover and fixed to the frame on its back face side.

Consequently, the movement is independent, especially of the back cover, and the electronic circuit is protected from shocks and stresses during any intervention requiring removal of the back cover.

According to a particular embodiment, the movement includes a plate on which is integrated the electronic circuit, this plate being mounted on the additional plate and inserted between the latter and the frame.

The movement may also comprise a spacer inserted between the plate and the additional plate.

The reduction mechanism is preferably mounted between the frame and the additional plate.

The reduction mechanism typically includes an intermediate wheel, meshed with the rotor pinion, and a third wheel, meshed with the intermediate wheel and the minute wheel.

The watch may also include a battery housing provided with a cylindrical body housed inside a cutout formed in the frame, and tabs that protrude radially from the body and are inserted between the frame and the additional plate.

In such case, the watch may further include a pair of contactors housed partially inside the battery housing, each contactor having an external tab pressed against a current contact pad of the electrical circuit.

The time display means include, for example:

- a minute wheel, integral with the minute hand;
- a sun wheel, integral with the arbor;
- an hour wheel integral with the hour hand;

An epicycloidal train which is rotatably mounted on the minute hand and includes a lower planetary wheel meshed with the sun wheel and an upper planetary wheel integral with the lower planetary wheel and meshed with the hour wheel.

The stator takes the form, for example, of an additional part inserted between the frame and the additional plate.

According to a particular embodiment, the electromagnet includes a coil wound onto a bar inserted between the frame and the additional plate, in contact with the stator.

BRIEF DESCRIPTION OF THE DRAWINGS

Other features and advantages of the invention will appear in light of the following description of one embodiment, made with reference to the annexed drawings, in which.

DETAILED DESCRIPTION OF THE INVENTION

Figure 1:
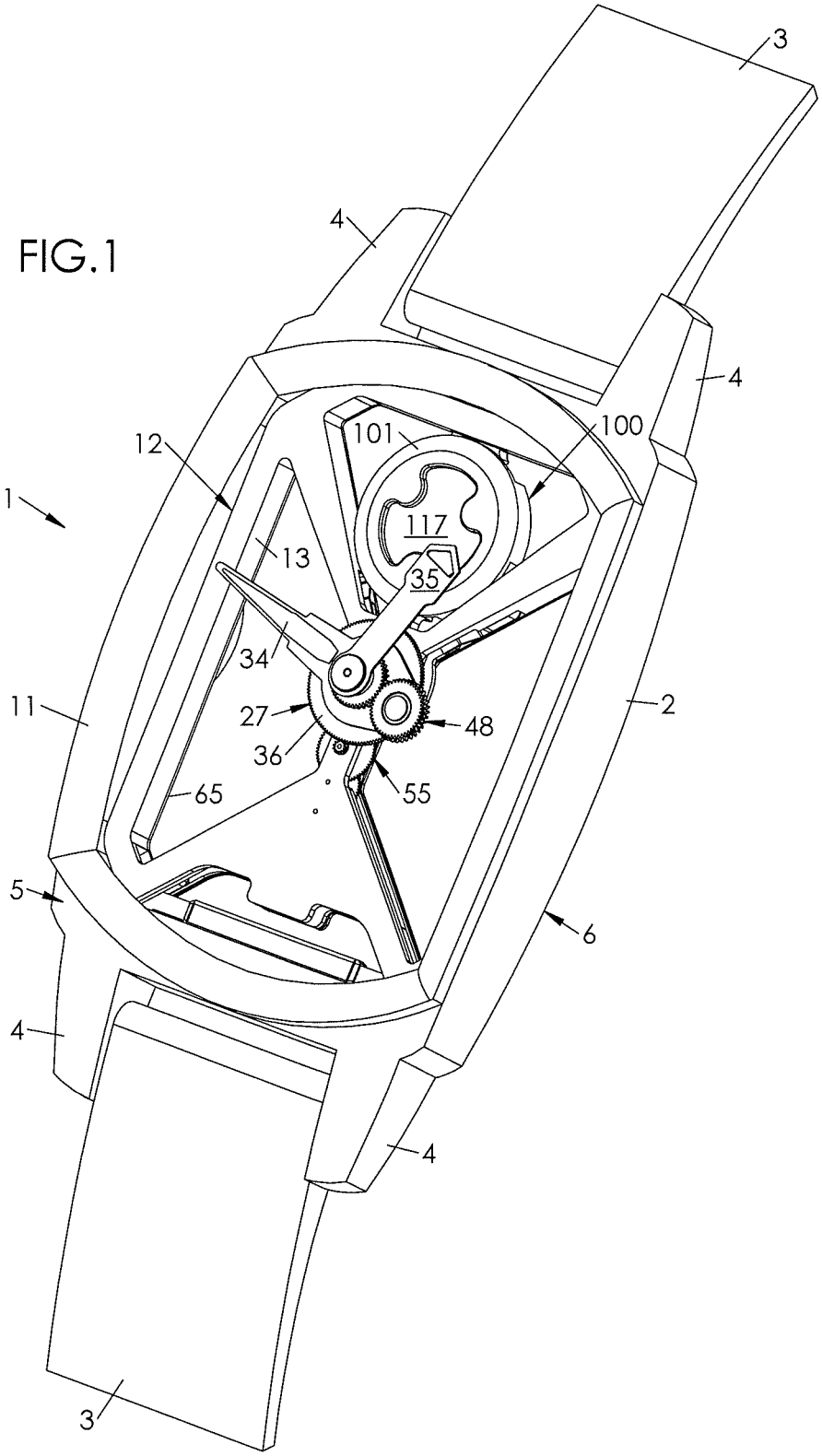
FIG. 1 is a perspective view showing an assembled skeleton watch.
Figure 2:
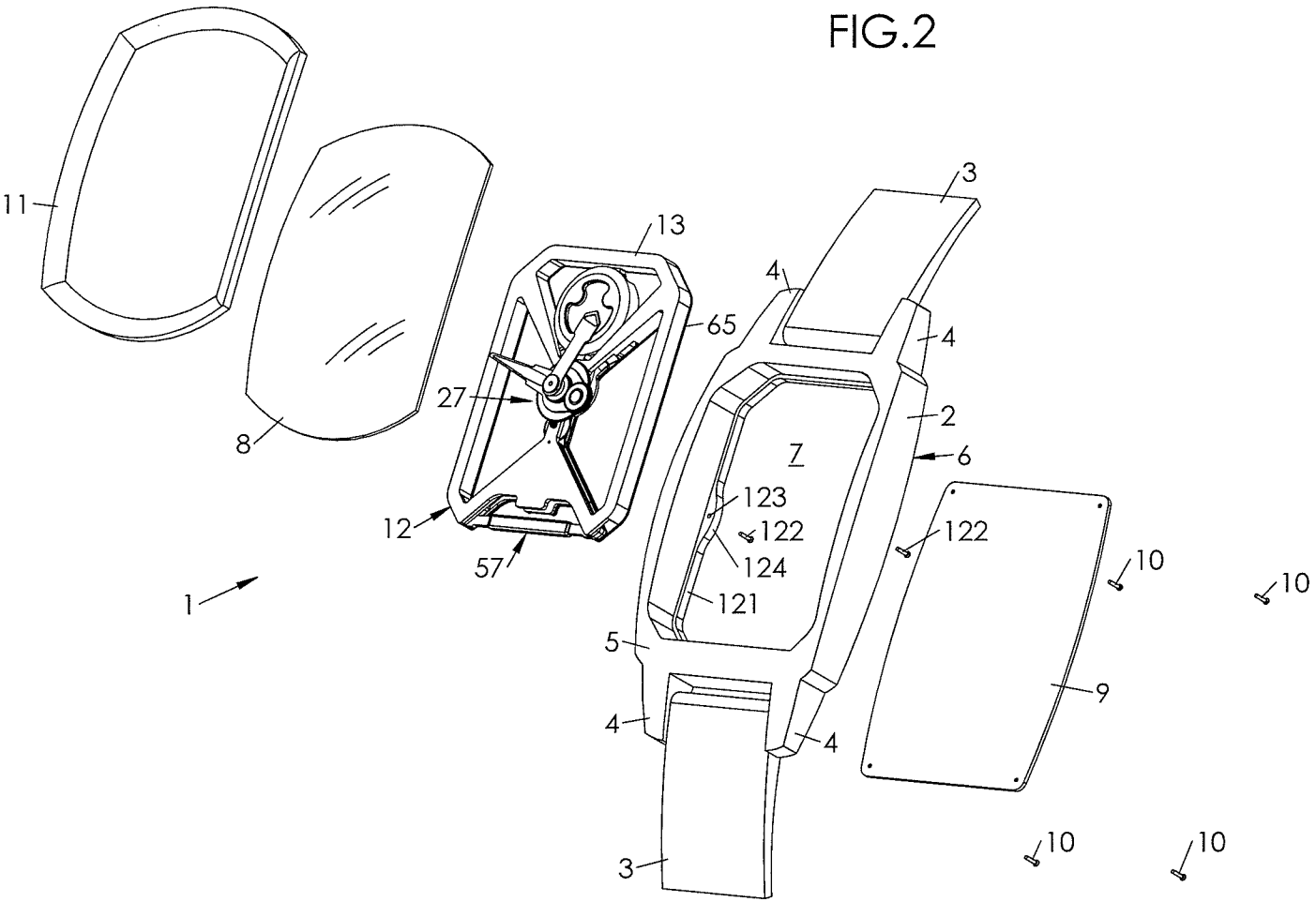
FIG. 2 is an exploded perspective view showing the skeleton watch of FIG. 1.

FIG. 1 and FIG. 2 represent a skeleton watch 1, so named since some of its internal parts are visible.

This watch 1 includes a case middle 2, which may, in particular, be made of metal (for example steel), or of a synthetic material (for example a composite material including a fibre-reinforced polymer matrix, typically carbon).

Watch 1 also includes, for wrist wear, a wristband 3 which attaches to case middle 2 between horns 4 that project from the latter.

In the illustrated example, case middle 2 has a rectangular contour, but this shape is not limiting. In particular, this contour could be rounded (for example circular or oval).

Case middle 2 has a front face 5 and a back face 6 which are opposite and define between them an interior space 7.

Watch 1 further includes a crystal 8 and a back cover 9, fixed to case middle 2 on either side of the latter (crystal 8 on the side of front face 5; back cover 9 on the side of back face 6) to enclose interior space 7.

Crystal 8 can be made of mineral or synthetic glass (for example ruby); back cover 9 is advantageously made of metal. As illustrated in FIG. 2, back cover 9 may be fixed to back face 6 of case middle 2 by means of screws 10.

As seen in FIG. 1 and FIG. 2, watch 1 further includes a bezel 11, affixed to front face 5 to ensure the attachment of crystal 8 to case middle 2, while ensuring a visually attractive finish.

Watch 1 includes, finally, a timepiece movement 12, hereinafter referred to simply as a 'movement'. As will be explained, this movement 12, once assembled, forms a unitary component independent of case middle 12 and of back cover 9.

Movement 12 includes, firstly, an openworked frame 13, whose function is to support certain moving parts, as will be seen hereinafter. This frame 13 is advantageously made of a non-electrically conductive material, especially a synthetic material (for example polymer, or a composite material including a fibre-reinforced polymer matrix, typically carbon). If frame 13 is made of polymer (for example polyoxymethylene, POM, or polytetrafluoroethylene, PTFE), or short fibre composite, it can be made by plastic injection moulding.

Frame 13 has an opposing front face 14 and back face 15. The external contour of frame 13 substantially corresponds to the internal contour of case middle 2, inside which it is intended to be fitted. Thus, according to an embodiment illustrated in the drawings, and in particular in FIGS. 2 to 5, frame 13 has a rectangular contour, but this shape is not limiting, and the contour could be rounded (for example circular or oval depending on the contour of case middle 2).

Figure 3:
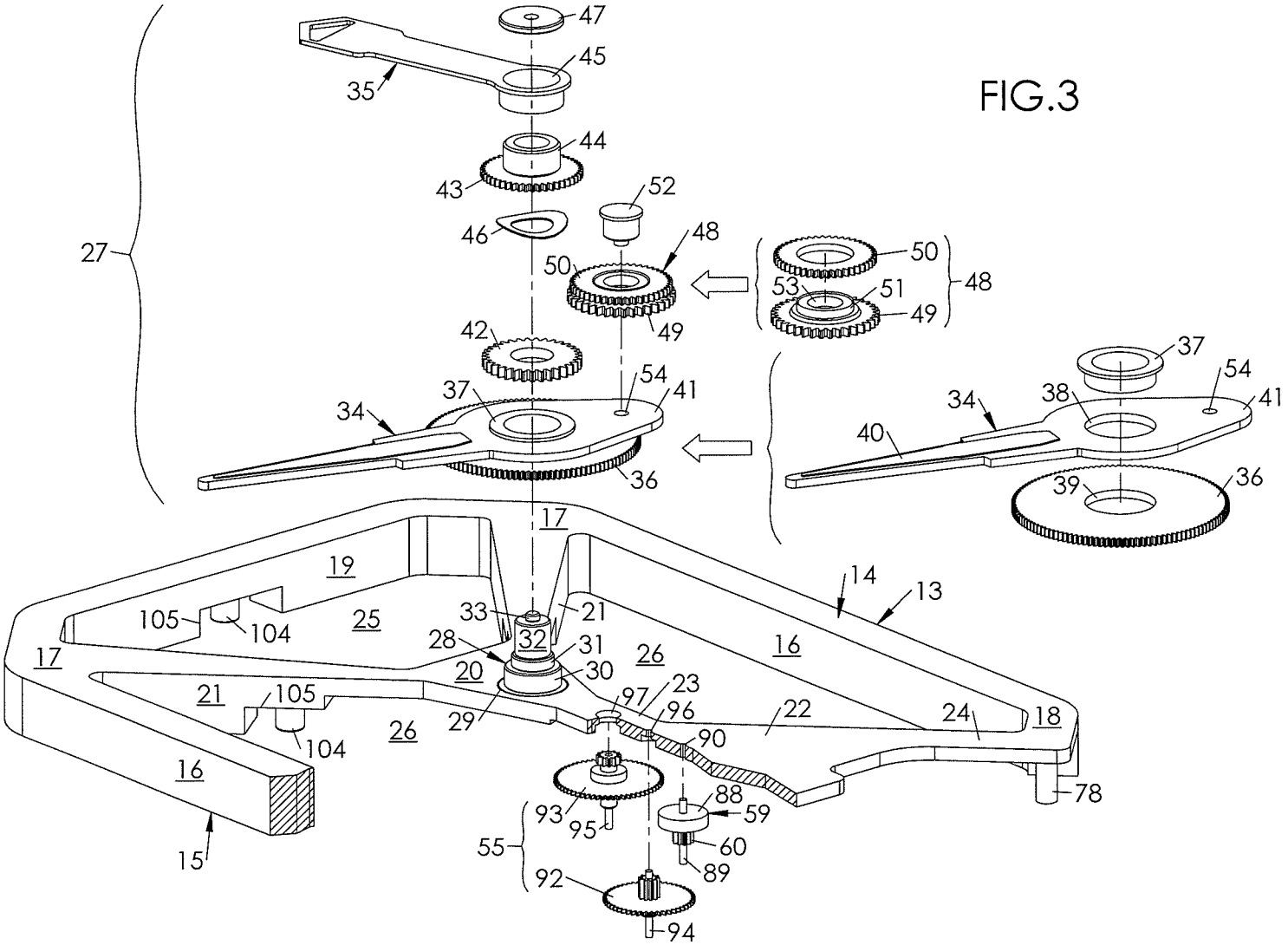
FIG. 3 is an exploded perspective view illustrating the assembly of the time display means and the reduction mechanism.
Figure 4:
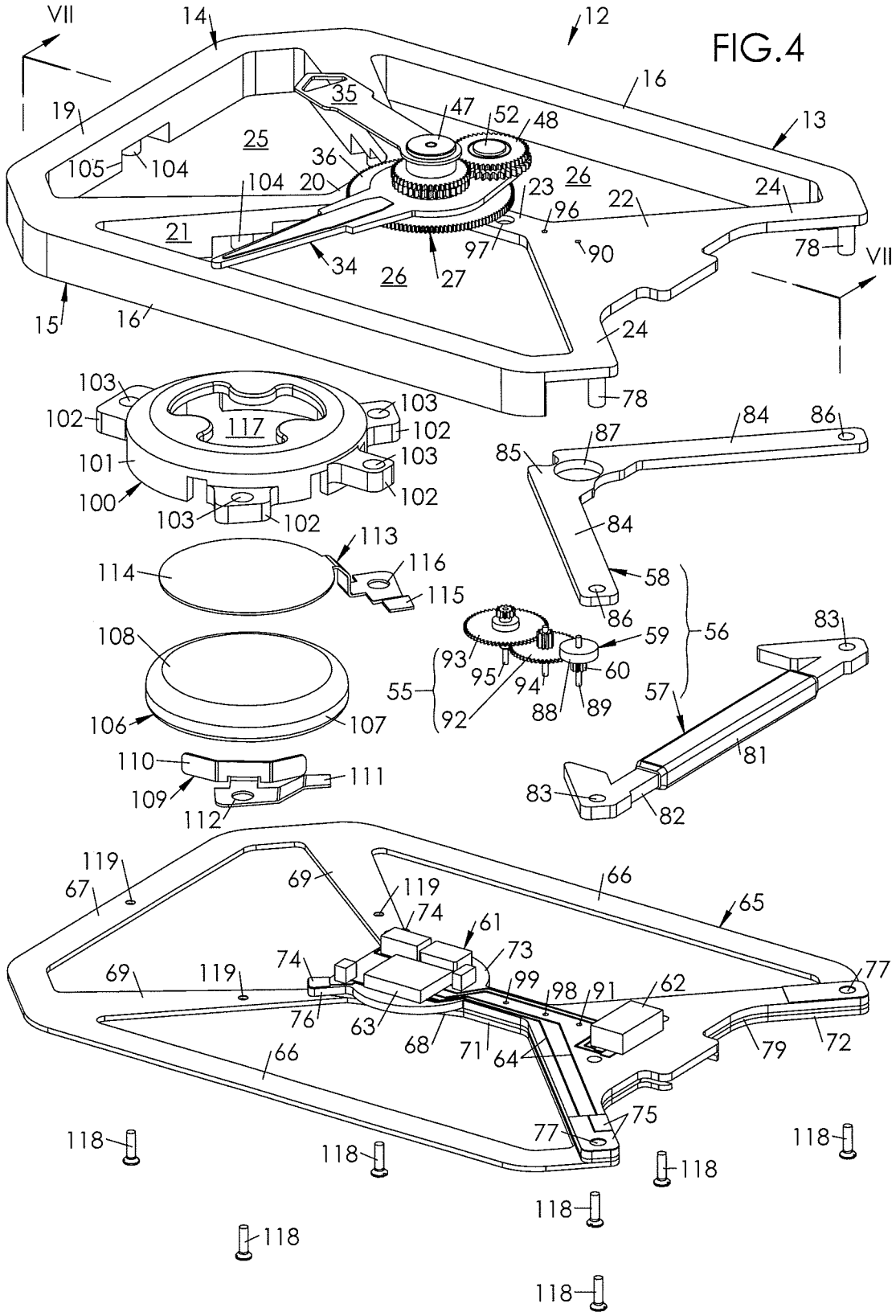
FIG. 4 is an exploded top view illustrating the assembly of the movement.

As illustrated in FIG. 3 and FIG. 4, frame 13 includes:

- two side posts 16, which extend parallel to each other and each have an upper end 17 and a lower end 18;
- a top bar 19 which connects posts 16 between their upper ends 17;
- a central island 20, which is connected to side posts 16, at their upper ends 17 (i.e. at their junction with top bar 19), by a pair of upper diagonal arms 21;
- a lower platform 22, which is connected to central island 20 by a bridge 23, and to the lower ends 18 of side posts 16 by a pair of lower diagonal arms 24.

Top bar 19, upper arms 21 and central island 20 define between them a wide upper cutout 25. Side posts 16, central island 20, bridge 23, lower platform 22 and lower arms 24 define between them wide side cutouts 26.

Together, upper arms 21, central island 20, bridge 23, platform 22 and lower arms 24 thus form a cross-shaped support structure which, with cutouts 25, 26, give watch 1 its skeleton appearance.

Movement 12 includes, secondly, time display means 27 mounted on frame 13 and whose function is to indicate the hours and minutes.

More specifically, these time display means 27 are mounted, on the side of front face 14 of frame 13, on a central arbor 28 integral with the frame.

According to an embodiment illustrated, in particular, in FIG. 3, arbor 28 is force fitted into a bore 29 made in central island 20, substantially at the geometric centre of frame 13.

As seen in FIG. 3, arbor 28 is stepped: it protrudes from front face 14 of frame 13 and includes a first shoulder 30; a second shoulder 31, of smaller diameter to first shoulder 30, a third shoulder 32, of smaller diameter than second shoulder 31, and ends, at a front end, in a threaded stud 33.

Time display means 27 include a minute hand 34 and an hour hand 35, moved in synchronous rotations in a reduction ratio of 1:12, i.e. hour hand 35 completes one twelfth of a turn when minute hand 34 completes one turn.

As illustrated in FIG. 3, time display means 27 include a minute wheel 36 integral with minute hand 34. This minute wheel has a large diameter; it has for example 120 teeth.

The attachment of minute wheel 36 to minute hand 34 is, for example, achieved by means of a rivet 37, driven into bores 38, 39 respectively made in minute hand 34 and minute wheel 36, as illustrated by the exploded view to the right of FIG. 3.

Minute hand 34 includes an indexing arrow 40, intended to indicate the number of minutes elapsed in one hour, and a plate 41 which extends diametrically opposite indexing arrow 40.

The sub-assembly comprising minute hand 34, minute wheel 36 and rivet 37 is mounted for free rotation on first shoulder 30 of arbor 28.

Time display means 27 also include a sun wheel 42 integral with arbor 28. This sun wheel 42 is mounted atop minute hand 34, secured by press fit to second shoulder 31 of arbor 28 and therefore fitted to frame 13 with no degree of freedom.

Time display means 27 further include an hour wheel 43, integral with hour hand 35. The attachment of hour wheel 43 and hour hand 35 to each other is advantageously achieved by press fit. More specifically, this attachment can be achieved by an oriented press fit, with hour wheel 43 carrying a bush 44 pressed into a bore 45 made in the hour hand.

The sub-assembly comprising hour hand 35 and hour wheel 43 is mounted for free rotation on third shoulder 32 of arbor 28, atop sun wheel 42. To limit friction, a curved washer 46 is preferably inserted between hour wheel 43 and sun wheel 42. To ensure that this sub-assembly remains on arbor 28, a nut 47 is fixed to stud 33 atop hour hand 35.

Time display means 27 include, finally, an epicycloidal train 48 rotatably mounted on plate 41 of minute hand 34. This epicycloidal train 48 includes a lower planetary wheel 49 meshed with sun wheel 42, and an upper planetary wheel 50, integral with lower planetary wheel 49 and meshed with hour wheel 43.

According to one embodiment illustrated in the exploded view to the top right of FIG. 3, the attachment of upper planetary wheel 50 to lower planetary wheel 49 can be achieved using rivets. More specifically, upper planetary wheel 50 is fitted onto a rivet 51 integral with lower planetary wheel 49, after which a flange of rivet 51 is deformed to ensure the attachment of upper planetary wheel 50 to lower planetary wheel 49.

As illustrated at the centre of FIG. 3, epicycloidal train 48 is fixed for free rotation on plate 41 of minute hand 34, by means of a pin 52 which, passing with clearance through a bore 53 made in rivet 51, is interference fitted in a hole 54 made in plate 41.

Movement 12 includes, thirdly, a reduction mechanism 55 meshed with time display means 27. This reduction mechanism 55 will be described in detail hereinafter.

In watch 1, the energy source that performs the rotation of hands 34, 35 is electric.

To ensure the transformation of electrical energy into mechanical energy, and the transmission of mechanical energy to time display means 27, movement 12 includes:

- fourthly, a stepping motor 56 including:
  - an electromagnet 57;
  - a stator 58 in electrical contact with electromagnet 57;
  - a rotor 59 bearing a pinion 60 meshed with reduction mechanism 55;
- fifthly, an electronic circuit 61 including:
  - a piezoelectric quartz 62;
  - a control circuit 63 connected to quartz 62 and to electromagnet 57 by means of electrical conductors 64.

Unlike most quartz watches, which include an electronic circuit all or partly formed on the back cover, electronic circuit 61 is separate from back cover 9 here.

To this end, movement 12 includes an additional plate 65 which carries electronic circuit 61. This additional plate 65 is distinct from back cover 9; it is fixed to frame 13 on its back face side 15, as illustrated in particular in FIG. 5.

Figure 5:
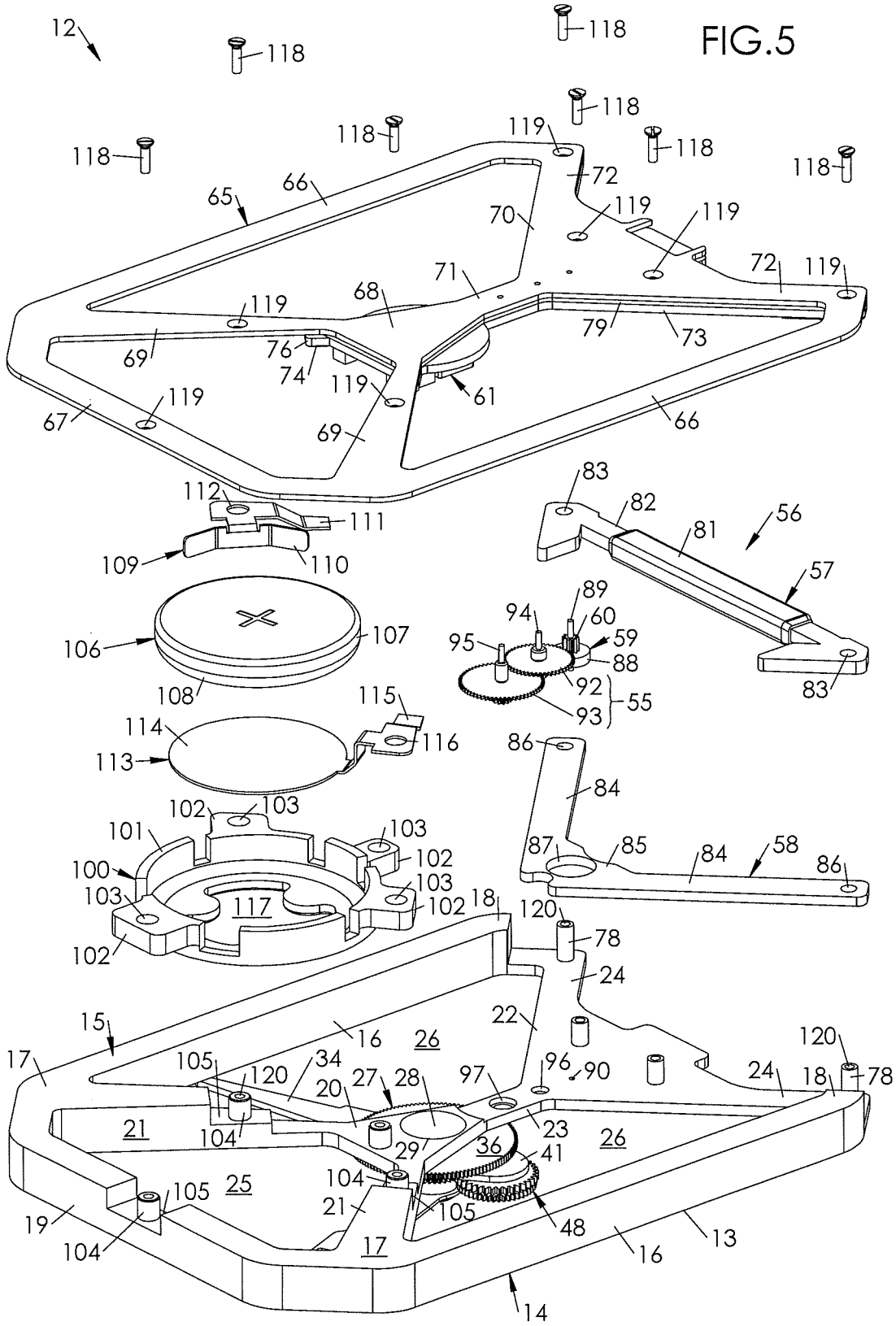
FIG. 5 is an exploded bottom view illustrating the assembly of the movement.

As seen in FIG. 4 and FIG. 5, additional plate 65 has a similar shape to that of frame 13. However, plate 65 has a smaller thickness than that of frame 13.

Thus, like frame 13, additional plate 65 includes:

- two side posts 66;
- a top bar 67 which connects side posts 16;
- a central island 68, which is connected to side posts 66 by a pair of diagonal upper arms 69;
- a lower platform 70, which is connected to central island 68 by a bridge 71, and to side posts 66 by a pair of lower diagonal arms 72.

Consequently, when additional plate 65 and frame 13 are superposed (FIG. 2, FIG. 7), they extend in the extension of one another.

Additional plate 65 can be made of a metal material (for example steel). In such case it can be made cutting (typically laser or water jet cutting) a thin sheet metal element. The advantage of a metal material is the structural stiffness that it gives movement 12, improving the operating precision of time display means 27.

Figure 6:
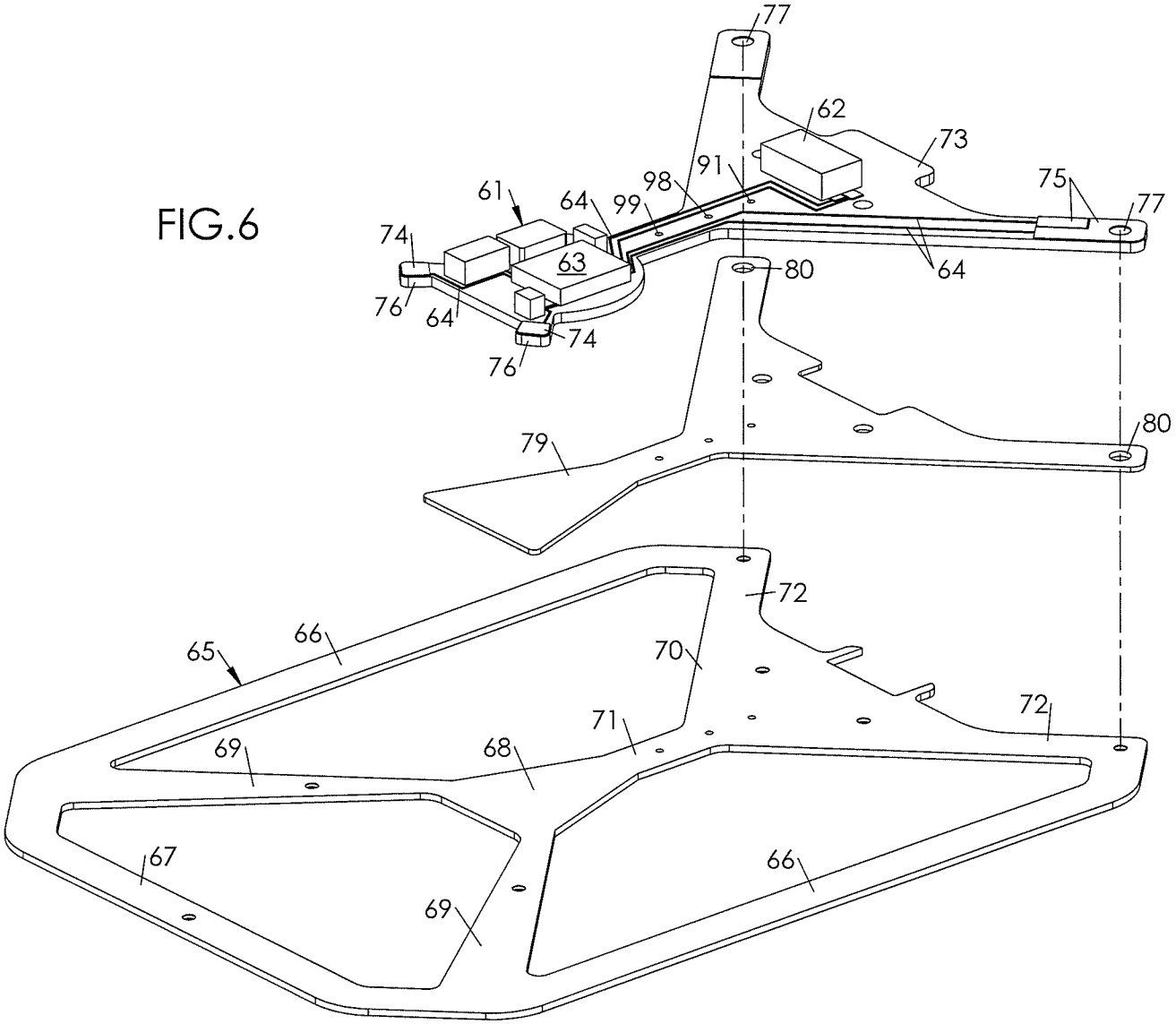
FIG. 6 is an exploded view illustrating the assembly of the additional plate and the electronic circuit.

According to a particular embodiment illustrated in the drawings, and especially in FIG. 6, electronic circuit 61 is not formed directly on additional plate 65: movement 12 includes for this purpose a plate 73 in which electronic circuit 61 is integrated.

Plate 73 is advantageously made of an insulating material, for example a polymer or a composite material including a fibre-reinforced polymer matrix (typically carbon).

As seen in FIG. 6, plate 73 has a substantially complementary profile to a central portion of frame 13 and additional plate 65. More specifically, in the illustrated example, the contour of plate 73 is complementary to islands 20, 68, bridges 23, 71, lower platforms 22, 70 and lower arms 24, 72.

Electronic circuit 61 includes various integrated components on plate 73, including quartz 62 (whose oscillating element, which is invisible, is housed inside a case) and control circuit 63. Electrical conductors 64, which are directly metallized on plate 73, connect the various components to perform the transmission of energy or information.

Pads 74, 75 are also directly metallized on plate 73, especially:

- a pair of electrical current contact pads 74, disposed on protruding lugs 76 formed on plate 73, and
- a pair of pads 75 for transmitting an electrical signal (from control circuit 63) to the electromagnet.

Plate 73 is mounted on additional plate 65 in-between the latter and frame 13.

To allow plate 73 to be assembled (with electrical circuit 61) without forming any excess thickness on frame 13, the latter is thinned at central island 20, bridge 23, platform 22 and lower arms 24 (c.f. FIG. 5).

To ensure the precise positioning of plate 73 relative to frame 13, plate 73 is provided with holes 77 which are placed over pins 78 protruding from the ends of lower arms 24 of frame 13.

According to a particular embodiment, movement 12 includes a spacer 79 inserted between plate 73 and additional plate 65.

This spacer 79, which has a similar contour to that of plate 73, is made of an electrically insulating material; its function is to electrically insulate plate 73 from additional plate 65, to prevent any short-circuits in electronic circuit 61. The positioning of spacer 79 relative to frame 13 is also achieved by means of holes 80 formed in plate 73, which are placed over pins 78.

Control circuit 63 receives from quartz 62 predetermined fixed frequency pulses, which clock an alternating electrical signal sent to electromagnet 57.

According to a particular embodiment, illustrated, in particular in FIG. 4, electromagnet 57 includes a coil 81 wound onto a metal bar 82 inserted between frame 13 and additional plate 65, in (electrical) contact with stator 58. As is also seen in FIG. 4, bar 83 is pierced with positioning holes 83 which are placed over pins 78.

Electromagnet 57 gives stator 58 a magnetisation whose polarity reverses in a period defined by the alternating electrical signal from control circuit 63 that passes through coil 81.

In the illustrated example, stator 58 takes the form of an added part, inserted between frame 13 and additional plate 65, and, more specifically, between frame 13 and bar 82 of electromagnet 57.

Stator 58 includes two arms 84 in a V-shape which are joined at a vertex 85. At their ends opposite to vertex 85, arms 84 are provided with positioning holes 86 which are placed over pins 78.

Stator 58 is provided, at its vertex 85, with a central bore 87, inside which is housed rotor 59. Rotor 59 is provided with a magnetized inertia block 88 which, driven by the changes in polarity of stator 58, moves rotor 59 in sequential movements of rotation at a predetermined angle.

Rotor 59 is provided with an arbor 89: it is mounted for free rotation between frame 13 and additional plate 65—and, more specifically, between frame 13 and plate 73, which include respective coaxial holes 90, 91 for guiding said arbor 89.

According to the embodiment illustrated in particular in FIG. 4 and FIG. 5, reduction mechanism 55 is also mounted between frame 13 and additional plate 65.

As seen in FIG. 3, reduction mechanism 55 includes an intermediate wheel 92, meshed with rotor pinion 60, and a third wheel 93, meshed with intermediate wheel 92 and with minute wheel 36.

Intermediate wheel 92 and third wheel 93 each include a respective arbor 94, 95, guided by holes 96, 97 made in the frame and by corresponding holes 98, 99 made in plate 73.

Watch 1 includes, sixthly, a battery housing 100 provided with a cylindrical body 101 housed inside upper cutout 25 of frame 13, and tabs 102 that protrude radially from body 101 and are inserted between frame 13 and additional plate 65.

More specifically, tabs 102 are provided with bores 103, which fit onto protruding pins 104 formed on frame 13, on its back face side 15. In the example illustrated in FIG. 5, where tabs 102 (like pins 104) are four in number, two pins 104 are situated substantially in the middle of upper arms 21; a third pin 104 is located on central island 20; and a fourth pin 104 is located in the middle of top bar 19.

At least some of pins 104 (in this case the pins 104 formed on upper arms 21 and pin 104 formed on top bar 19) are advantageously formed in hollows 105 made in the back face of frame 13, substantially complementary to tabs 102, and inside which the latter are fitted.

Housing 100 is configured to receive a button cell battery, typically a lithium battery, which includes an anode 107 (positive pole) forming the periphery of battery 106, and a cathode 108 (negative pole) forming one side of the battery.

To pick up the current from battery 106 and electrically power electronic circuit 61, watch 1 includes a pair of contactors partially housed inside housing 100, namely:

- an anode contactor 109, including a strip 110 which comes into lateral contact with anode 107 and an external lug 111 pierced with a hole 112 and applied against a contact pad 74 of electronic circuit 61;
- a cathode contactor 113, which includes a disc 114 in contact with cathode 108, and an external lug 115 pierced with a hole 116 and applied against the other contact pad 74 of electronic circuit 61.

According to an embodiment illustrated in particular in FIG. 4, the housing is provided with a cutout 117 which provides a glimpse of disc 114 of cathode contactor 113. Consequently, it is possible to etch the latter to inscribe thereon indications relating, for example, to the trademark under which watch 1 is sold.

To assemble watch 1, the procedure is as follows.

Initially time display means 27 is assembled and mounted on frame 13, as illustrated in FIG. 3.

To this end, arbor 28 is mounted on frame 13, by forcing it into its central bore 29, on its back face side 15.

The sub-assembly comprising minute hand 34 and minute wheel 36 is formed, fixed together by means of rivet 37 and mounted for free rotation on first shoulder 30 of arbor 28.

Then, sun wheel 42 is driven onto second shoulder 31 of arbor 28.

Epicycloidal train 48 is formed by riveting upper planetary wheel 50 onto lower planetary wheel 49. Epicycloidal train 48 is then mounted on minute hand 34 by means of pin 52 which is fitted (for free rotation) inside bore 53 of rivet 51 and (forced) into hole 54 made in plate 41, while ensuring that lower planetary wheel 49 meshes with sun wheel 42.

Next, the sub-assembly comprising hour wheel 43 and hour hand 35 is formed by pressing the latter onto bush 44. Then, this sub-assembly is mounted for free rotation on the third shoulder 32 of arbor 28, with curved washer 49 inserted between hour wheel 43 and sun wheel 42.

Then, nut 47 is screwed onto stud 33 to hold the sub-assembly comprising hour wheel 43 and hour hand 35 on bush 44. Time display means 27 are thus made integral with frame 13.

Frame 13 should then be turned over so that back face 15 is oriented upwards ready for the assembly of battery housing 100, motor 56, reduction mechanism 55 and electronic circuit 61.

Stator 58 is mounted first, by affixing it to lower platform 22 and placing positioning holes 86 over pins 78.

Rotor 59 is then mounted, by fitting its arbor 89 into hole 90, inertia block 88 then being housed inside bore 87 of stator 58. Then third wheel 93 is mounted by placing its arbor 95 in hole 97, followed by intermediate wheel 92, by placing its arbor 94 in hole 96. Electromagnet 57 is mounted by placing positioning holes 82 of bar 82 over pins 78.

Battery housing 100 should then be mounted on frame 13. To this end, tabs 102 are fitted inside hollows 105; bores 103 are then placed over pins 104. Cathode contactor 113 is then added, placing disc 114 at the bottom of battery housing 100, and placing hole 116 over a pin 104 of one of upper arms 21. Then, anode contactor 109 is added by inserting strip 110 into battery housing 100 and placing hole 112 over a pin 104 of the other upper arm 21.

Battery 106 can then be inserted into housing 100, and the latter can be closed by means of a cover (not represented). In a variant, battery 106 is intended to be held inside case 100 by back cover 9.

Plate 73 carrying electronic circuit 61, spacer 79 and additional plate 65 are then added and mounted (in that order) on frame 13. In so doing:

- holes 77 in plate 73 are placed over pins 78 of frame 13;
- holes 80 in spacer 79 are also placed over pins 78 of frame 13;
- rotor arbor 89 is placed in hole 91 of plate 73;
- arbor 94 of intermediate wheel 92 is placed inside hole 98 of plate 73;
- arbor 95 of third wheel 93 is placed in hole 99 of plate 73.

Additional plate 65 is then added for attachment to frame 13, covering plate 73 and spacer 79. Plate 65 is attached directly to frame 13, by means of screws 118 which, passing through holes 119 made in plate 65, are then engaged in bores 120 made in pins 78, 104.

Figure 7:
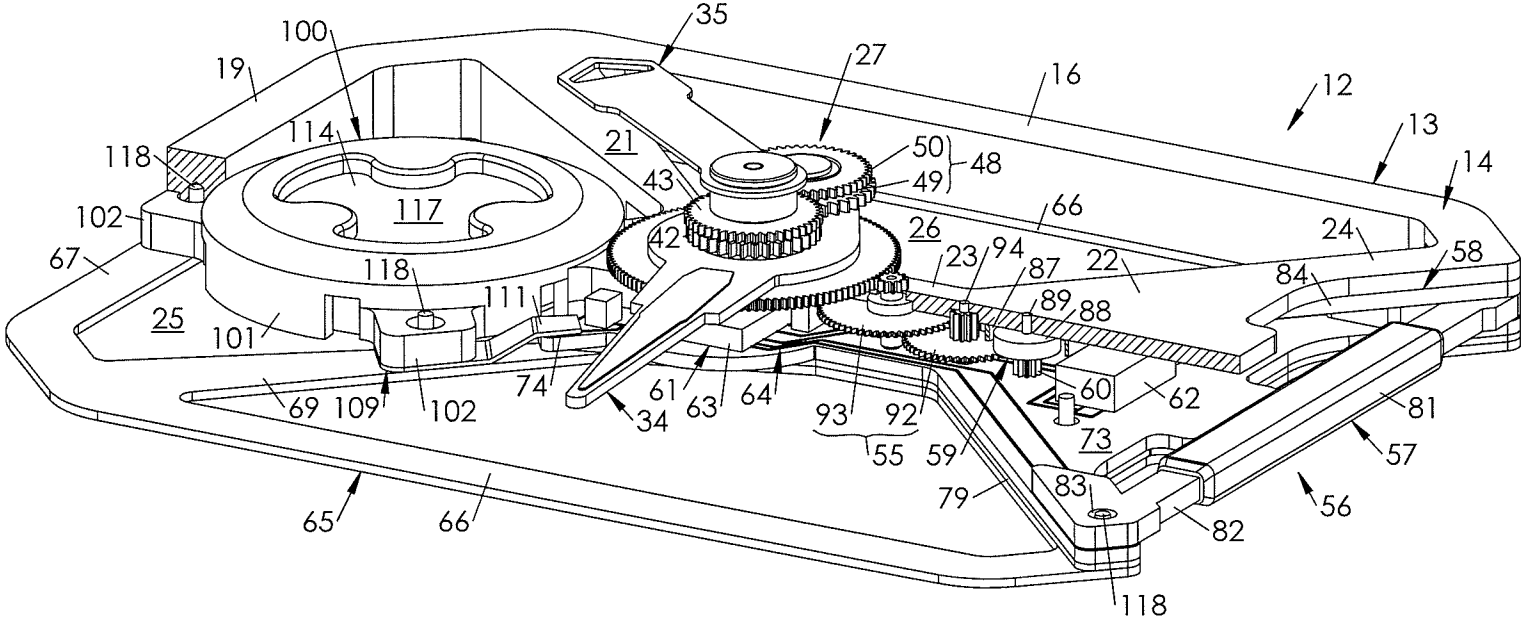
FIG. 7 is a perspective, partial cross-sectional view (along plane VII-VII of FIG. 4) showing the assembled movement.

The assembly of movement 12 is thus complete, as illustrated (in partial cross-section) in FIG. 7 and in FIG. 2. Movement 12 is operational (assuming that electronic circuit 61 is powered by a battery 106). It is seen that, both structurally and operationally, movement 12 is independent of case middle 2 and of back cover 9 (account is not take here of any time correction mechanism).

Movement 12 can then be mounted inside case middle 2. To this end, movement 12 is fitted into interior space 7. To ensure the proper positioning of movement 12, case middle 2 is advantageously provided, on its inner periphery, with a rim 121 on which movement 12 (and more specifically additional plate 65) comes to bear. The attachment of movement 12 to case middle 2 can be achieved by means of screws 122 which, through bores 123 made in protruding bulges 124 formed on rim 121, engage in additional plate 64, or directly in frame 13.

Back cover 9 is fixed to front face 6 by means of screws 10; crystal 8 is added to back face 5 and secured thereto by means of bezel 11, which is fixed to case middle 2 in a press fit or by means of screws (not represented).

As already mentioned, during operation, control circuit 63 generates, on pulses received from piezoelectric quartz 62, an alternating electrical signal sent to electromagnet 57, whose stator 58 moves rotor 59 in sequential rotational movements. The rotation of rotor 59 is transmitted with gear reduction, via pinion 60, intermediate wheel 92 and third wheel 93, to minute wheel 36. Control circuit 63 is programmed and pinion 60 and wheels 36, 92, 93 are sized such that minute wheel 36 (and minute hand 34 therewith) makes one complete rotation in one hour.

Sun wheel 42, epicycloidal train 48 and hour wheel 43 are sized such that the reduction ratio, referenced r, between sun wheel 42 and hour wheel 43 is 1:12.

Noting that:

N1 the number of teeth of sun wheel 42,

N2 the number of teeth of lower planetary wheel 49,

N3 the number of teeth of upper planetary wheel 50,

N4 the number of teeth of hour wheel 43, the reduction ratio r is written:

$$r = 1 - \frac{N1}{N2} \cdot \frac{N3}{N4}$$

To obtain a reduction ratio r of 1:12, it is thus possible to choose, as below, the numbers N1, N2, N3 and N4:

N1=33

N2=36

N3=46

N4=46

The structure of movement 12, and in particular its subdivision into a frame 13 (bearing time display means 27) and an additional plate 65 (bearing electronic circuit 61) fixed to frame 13, allows movement 12 to be separated from case middle 2, which has the following advantages:

during any intervention in watch 1 that requires access to movement 12, electronic circuit 61, sandwiched between frame 13 and additional plate 65, is well protected from shocks and stresses;

electronic circuit 61 enjoys good thermal protection from back cover 9, and is thus protected from the stresses and thermal cycles to which the back cover is subjected;

removing back cover 9, during intervention in watch 1, does not affect the operation of movement 12, since electronic circuit 61, motor 56 and the time display means remain integral.

What is claimed is:

1. A skeleton watch comprising:

a case middle which defines an interior space;

a crystal and a back cover fixed to the case middle on either side of the middle to enclose the interior space; and a movement that includes:

an openworked frame having a front face and a back face, the frame including an outer perimeter formed by:

two side posts, a top bar that connects between upper ends of the side posts, and a lower platform connected to lower ends of the side posts, wherein the frame includes a central island positioned within the outer perimeter;

time display means mounted, on the front face side of the frame, on a central arbor integral with the frame, said time display means including a minute hand and an hour hand;

a reduction mechanism meshed with the time display means;

a motor including:

an electromagnet that extends outside of the outer perimeter of the frame in a radial direction from the central arbor;

a stator; and a rotor bearing a pinion meshed with the reduction mechanism; and an electronic circuit including:

a piezoelectric quartz; and a control circuit connected to the quartz and to the stator by means of electrical conductors;

wherein the movement includes an additional plate which carries the electronic circuit, said additional plate being distinct from the back cover and fixed to the frame on its back face side.

2. The watch according to claim 1, wherein the movement includes a plate on which is integrated the electronic circuit, said plate being mounted on the additional plate and inserted between the latter and the frame.

3. The watch according to claim 2, wherein the movement includes a spacer inserted between the plate and the additional plate.

4. The watch according to claim 1, wherein the reduction mechanism is mounted between the frame and the additional plate.

5. The watch according to claim 4, wherein the reduction mechanism includes an intermediate wheel, meshed with the pinion of the rotor, and a third wheel, meshed with the intermediate wheel and the minute wheel.

6. The watch according to claim 1, wherein the watch includes a battery housing provided with a cylindrical body housed inside a cutout formed in the frame, and tabs that protrude radially from the body and are inserted between the frame and the additional plate.

7. The watch according to claim 6, wherein the watch includes a pair of contactors partially housed inside the battery housing, each contactor having an external tab applied against a current contact pad of the electrical circuit.

8. The watch according to claim 1, wherein the time display elements include:

a minute wheel, integral with the minute hand;

a sun wheel, integral with the arbor;

an hour wheel integral with the hour hand;

an epicycloidal train which is rotatably mounted on the minute hand and includes a lower planetary wheel meshed with the sun wheel and an upper planetary wheel integral with the lower planetary wheel and meshed with the hour wheel.

9. The watch according to claim 1, wherein the stator is positioned between the back face of the frame and the additional plate in an axial direction of the central arbor.

10. The watch according to claim 9, wherein the electromagnet includes a coil wound onto a bar inserted between the back face of the frame and the additional plate in the axial direction of the central arbor, in contact with the stator.

11. The watch according to claim 1, wherein the electromagnet extends between the lower ends of the side posts.

* * * * *